US005950942A

United States Patent [19]

Brand et al.

[11] Patent Number: 5,950,942

[45] Date of Patent: Sep. 14, 1999

[54] TUB GRINDER

[75] Inventors: Ivan Ray Brand; Jeff Alan Fleenor, both of Pella; Thomas Dean Ogle, Grinnell; Fred H Lucas, Sigourney, all of Iowa

[73] Assignee: Vermeer Manufacturing Co., Pella, Iowa

[21] Appl. No.: 09/148,400

[22] Filed: Sep. 4, 1998

Related U.S. Application Data

[63] Continuation of application No. 08/748,545, Nov. 13, 1996, Pat. No. 5,803,380, which is a continuation-in-part of application No. 08/642,054, May 3, 1996, abandoned.

[51] Int. Cl.[6] ..... B02C 13/286

[52] U.S. Cl. ..... 241/101.761; 241/186.4

[58] Field of Search ..... 241/101.761, 186.4

[56] References Cited

U.S. PATENT DOCUMENTS

| | | | |
|---|---|---|---|
| 3,966,128 | 6/1976 | Anderson et al. . | |
| 4,585,180 | 4/1986 | Potts . | |
| 4,846,411 | 7/1989 | Herron et al. . | |
| 4,997,135 | 3/1991 | Zehr . | |
| 5,375,784 | 12/1994 | Worley . | |
| 5,419,502 | 5/1995 | Morey . | |
| 5,507,441 | 4/1996 | De Boef et al. . | |
| 5,542,617 | 8/1996 | Rajewski . | |
| 5,803,380 | 6/1998 | Brand et al. | 241/101.761 |

*Primary Examiner*—Mark Rosenbaum

*Attorney, Agent, or Firm*—Merchant & Gould P.C.

[57] ABSTRACT

A tub grinder includes a tub mounted for rotation about a vertical axis. A grinding member is positioned within a floor of the tub grinder. A deflection plate partially covers the floor to define a narrow trajectory area for debris being ejected from the tub. A deflection cover is secured to the frame covering the tub opening only over the deflection area.

12 Claims, 9 Drawing Sheets

TUB GRINDER

CROSS REFERENCE TO RELATED APPLICATION

The present application is a continuation of U.S. patent application Ser. No. 08/748,545 filed Nov. 13, 1996, now U.S. Pat. No. 5,803,380, which is a continuation-in-part of U.S. patent application Ser. No. 08/642,054 filed May 3, 1996 now abandoned.

I. BACKGROUND OF THE INVENTION

1. Field of the Invention

This invention pertains to tub grinders for grinding waste material. More particularly, this invention pertains to a cover and other elements for reducing debris ejection out of the tub grinder during operation.

2. Description of the Prior Art

Tub grinders for grinding organic waste material (such as trees, brush and the like) are well known. An example of such is shown in commonly assigned U.S. Pat. No. 5,507,441 dated Apr. 16, 1996. Another example is shown in U.S. Pat. No. 5,419,502 dated May 30, 1995.

Tub grinders include a rotary grinding member which is mounted on a frame for rotation about a horizontal axis. A rotating tub surrounds the grinding member. The tub rotates about a general vertical axis. Debris is deposited in the rotating tub and the rotary grinding member grinds the debris.

Tub grinders are powerful machines. Commonly, a tub grinder may be powered by a 400 horsepower motor with the grinder rotating at about 2100 rpm.

Tub grinders are intended for use in grinding organic waste material (e.g., brush, wood, grass, leaves, paper, etc.). Occasionally, through misuse of the tub grinder or the like, metal or other undesired material may be admitted to the tub grinder. The rotary tub grinder may eject material from the tub resulting in projectiles being thrown from the tub during its use.

U.S. Pat. No. 4,585,180 shows a hood (item 34 in FIG. 4 of the '180 patent) which serves to deflect material downwardly. Such hoods are positioned directly above the grinding member and have been used to limit the amount of material which may be deflected by the grinding member. However, even with such hoods, material may still be deflected out of the tub.

Other designs for reducing the amount of debris projection have included a deflection plate mounted on an interior wall of the tub where the deflection plate was angled both radially inwardly and downwardly toward the central axis of the rotating tub.

Notwithstanding the prior techniques for reducing deflection of material from a tub, there is an increased need for providing novel means for reducing the amount of debris material being deflected for a tub grinder. It is an object of the present invention to provide such an apparatus.

II. SUMMARY OF THE INVENTION

According to a preferred embodiment of the present invention, a tub grinder is provided which includes a frame having a generally horizontal floor. A tub is mounted on the frame with the wall of the tub surrounding a floor opening and with the tub having a lower end in close proximity to the floor. An upper end of the tub is open to define a tub opening. The tub is rotated about a generally vertical axis. A grinding member is mounted on the frame for a rotation about a generally horizontal axis. A portion of a circumferential area of the grinding member is exposed through the floor opening. A deflection plate is secured to the floor and extends partially over a first side of the floor opening to partially cover the grinding member. A deflection cover is secured to the frame and positioned above the tub opening covering only a portion of the tub opening.

III. BRIEF DESCRIPTION OF THE DRAWINGS

IV. DESCRIPTION OF THE PREFERRED EMBODIMENT

Referring now to the several drawings figures in which identical elements are numbered identically throughout, a description of the preferred embodiment to the present invention will now be provided.

Figure 1:
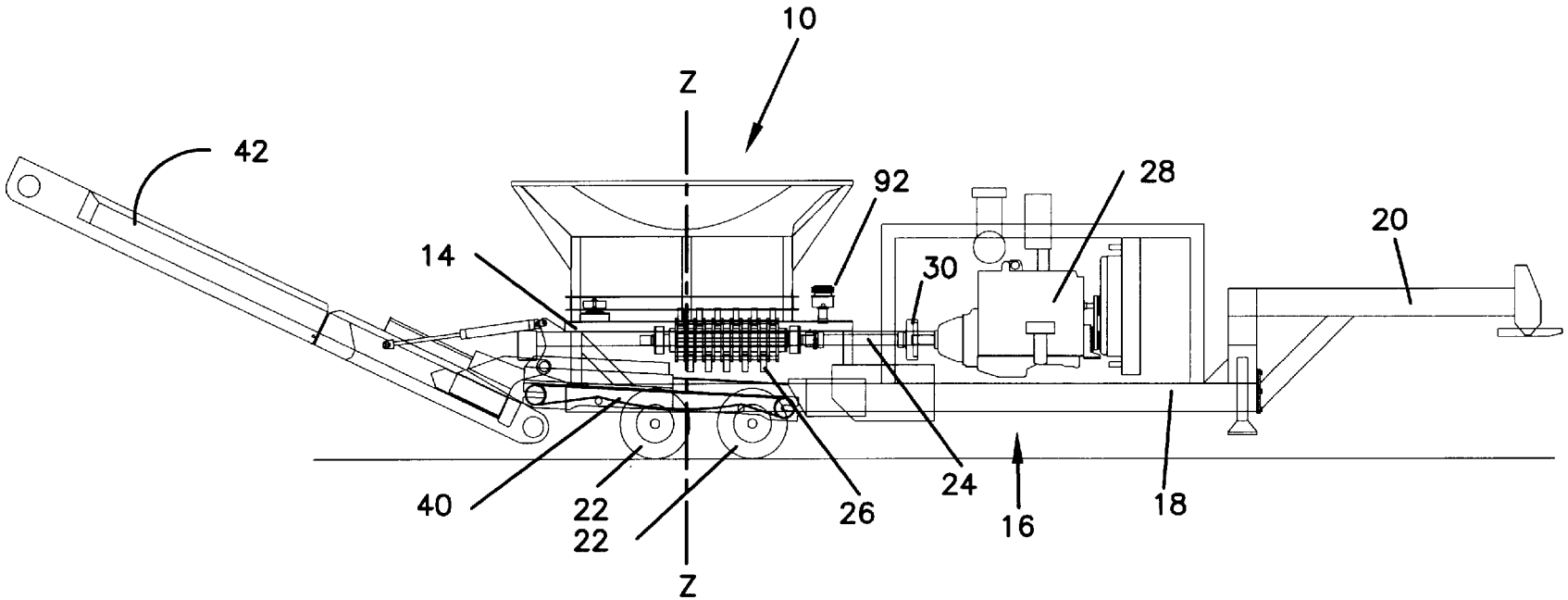
FIG. 1 PRIOR ART
FIG. 1 is a side elevation schematic view of a prior art tub grinder.
Figure 2:
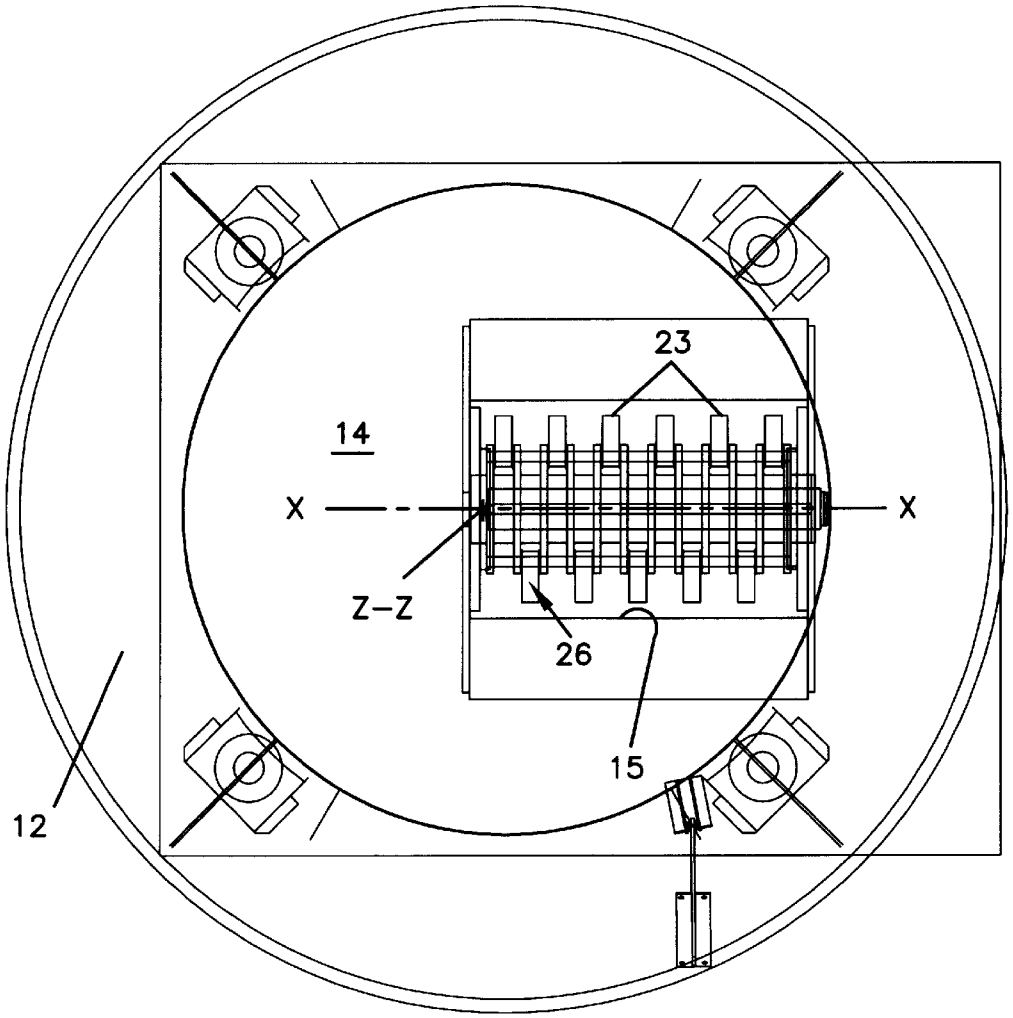
FIG. 2 PRIOR ART
FIG. 2 is a top plan view of the tub of the device of FIG. 1.

With initial reference to FIGS. 1 and 2, a prior art tub grinder 10 such as that shown in commonly assigned U.S. Pat. No. 5,507,441 is shown. The tub grinder 10 includes a rotary tub 12 mounted above a horizontal floor 14 for rotation about a vertical axis Z—Z. The floor 14 and tub 12 are secured to a frame 18 of a trailer 16. The frame 18 includes a boom 20 for attachment to a cab for towing the tub grinder 10. Wheels 22 are mounted on the frame 18.

Mounted within the frame 18 is a rotary grinder member 26. As best illustrated in FIG. 2, the floor 14 includes a floor opening 15. A portion of the circumferential area of the grinder 26 is exposed through the floor opening 15. The grinder 26 is mounted for rotation about a horizontal axis X—X and includes a plurality of hammer members 23 which engage and crush waste material deposited in the tub 12.

The grinding member 26 is coupled via a shaft 24 to an engine 28 for rotating the grinding member 26. In operation, the tub 12 is rotated about axis Z—Z by a motor 92 (shown in FIG. 1). Simultaneously, the grinding member 26 is rotated about axis X—X.

Waste wood material is deposited into the interior of the tub 12 by means of a crane or the like. The combined action of the rotation of tub 12 and rotation of the grinding member 26 causes the waste material to be broken down and deposited on a belt 40 carried on the frame 18 beneath the grinder member 26 as shown in FIG. 1. The belt 40 deposits the crushed and ground waste material onto a conveyor 42 for discharge.

It will be appreciated that a tub grinder 10 as thus described forms no part of this invention per se and is illustrated for the purpose of facilitating an understanding of the present invention. The present invention is directed towards apparatus for reducing undesired discharge of the waste material through the upper end of the tub during operation. Such discharge may result in projectiles which can be thrown a substantial distance from the tub at substantial velocities representing a potential safety hazard. Since the apparatus of the present invention is intended for use on a tub grinder 10 such as that shown in FIGS. 1 and 2, elements in common with FIGS. 1 and 2 are numbered identically throughout the remaining figures.

Figure 6:
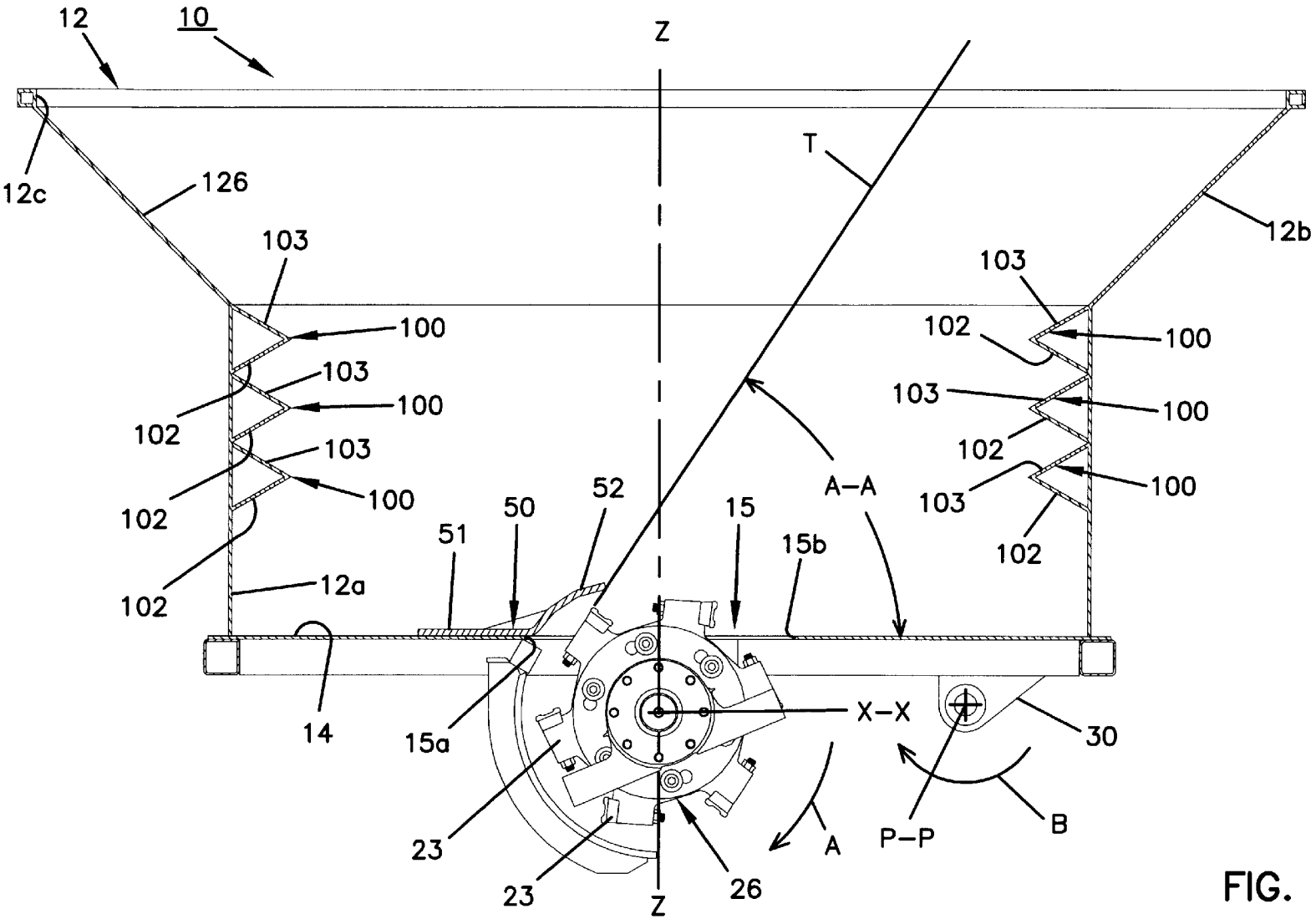
FIG. 6 is a front cross-sectional view of the tub grinder of FIG. 3 with a cover removed for purposes of illustration.
Figure 7:
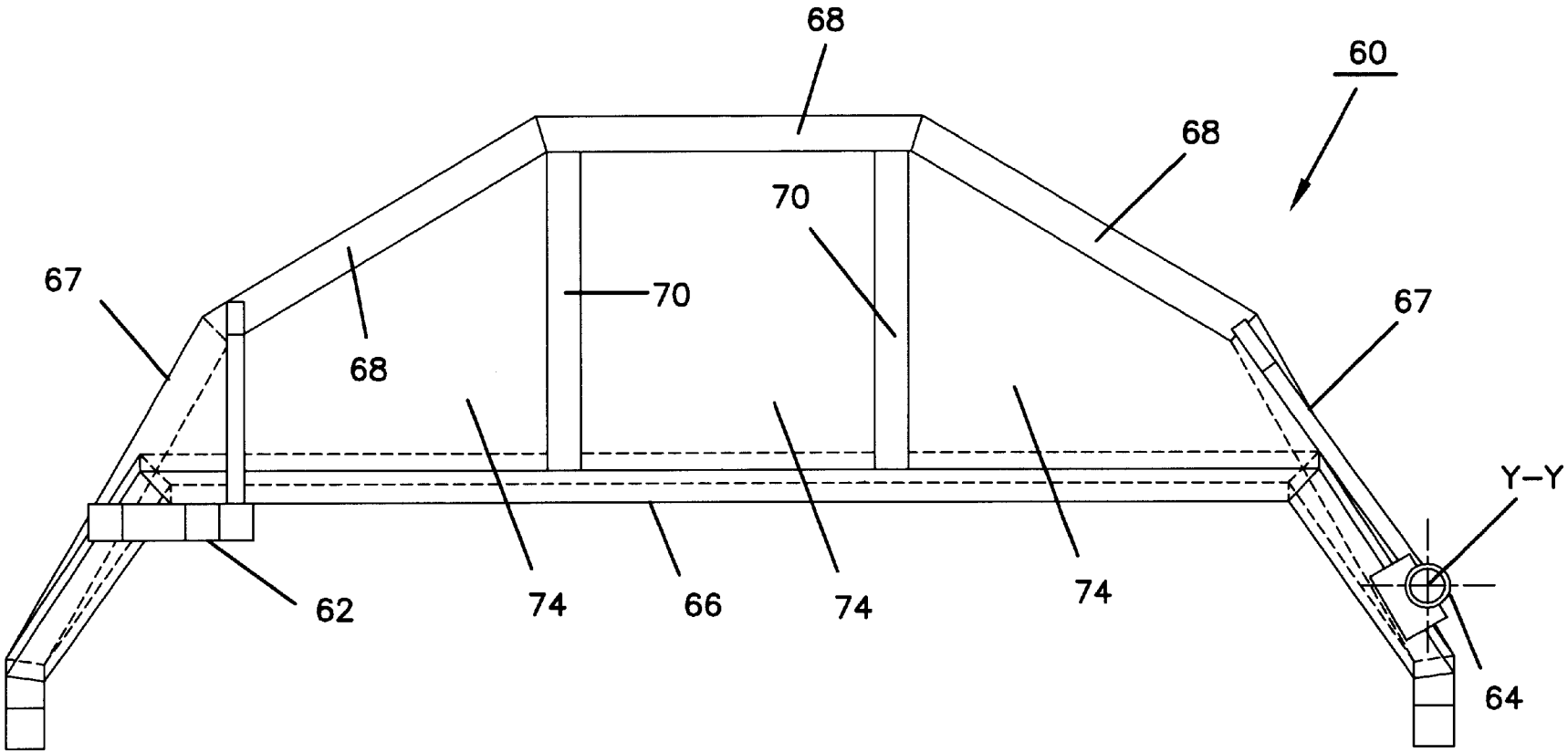
FIG. 7 is a top plan view of a tub cover for the tub grinder of FIG. 3.
Figure 8:
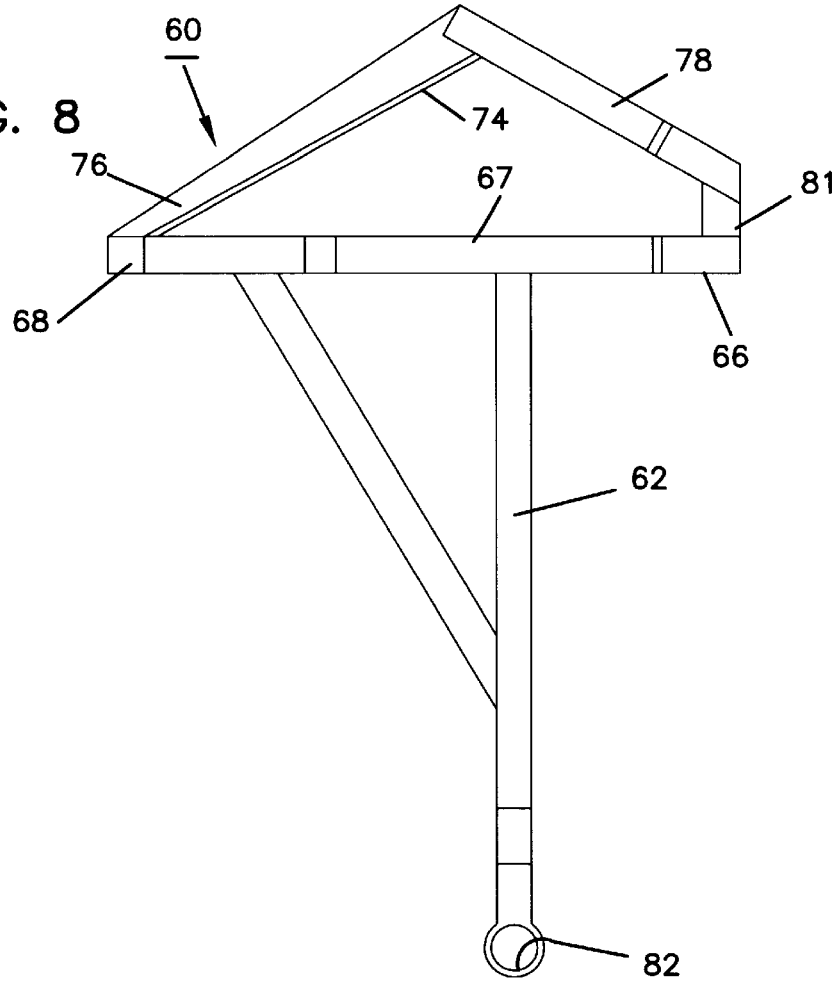
FIG. 8 is a rear side elevation view of the cover of FIG. 7.
Figure 9:
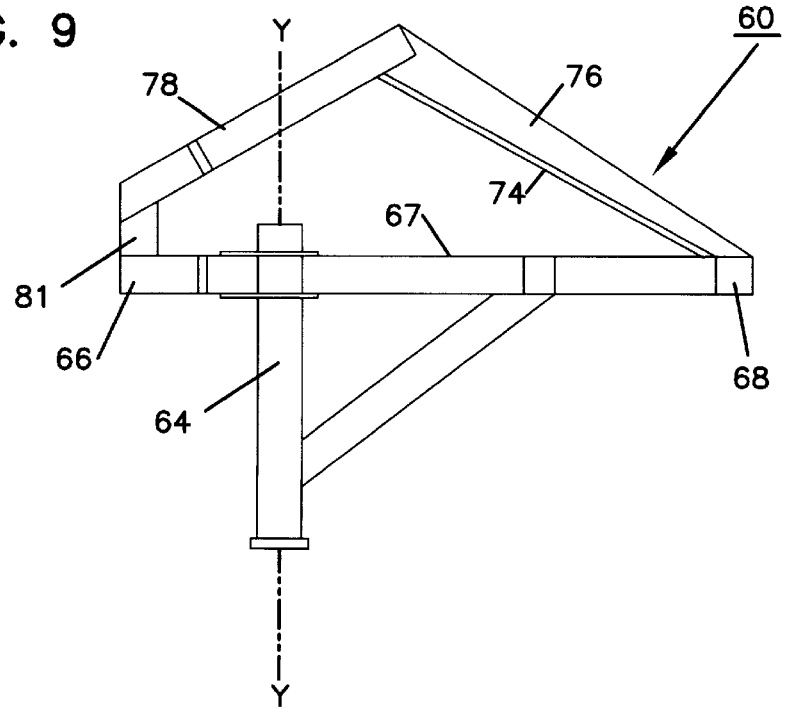
FIG. 9 is an opposite end view of the view of FIG. 8.

With reference now to FIG. 6, a tub grinder 10 is shown in cross-section. The tub 12 rests on floor 14 and is rotatable about vertical axis Z—Z. The grinding member 26 rotates about axis X—X in the direction of rotation indicated by arrow A.

As the rotary member 26 rotates about axis X—X, the hammer members 23 pass up a first side 15*a* of the floor opening 15 to point above the floor 14 and then pass downwardly through a second side 15*b* of the opening 15.

The tub 12 includes a generally cylindrical wall 12*a* with a lower end of the wall 12*a* in close proximity to the floor 14 as the tub 12 rotates about axis Z—Z. In commercially sized tub grinders 10, the cylindrical wall 12*a* may have a diameter of about 8 feet. Secured to an upper end of the circumferential wall 12*a* is frusto-conical portion 12*b* which terminates at an upper tub opening 12*c*. The tub opening 12*c* typically has a diameter of about 12 feet. In a commercially sized tub grinder 10, the cylindrical wall 12*a* has a vertical height of about 3 feet and the frusto-conical portion 12*b* has a vertical height of about 2 feet.

Both the floor 14 and the tub 12 are connected to a pivot flange 30 such that both of the tub 12 and floor 14 may be pivoted about a pivot point P—P in the direction of arrow B in FIG. 6. The tub 12 and floor 14 may be pivoted 90 degrees to permit discharge of waste material from the tub and access by workers into the interior of the tub 12 for cleaning purposes and the like. It will be appreciated that a pivoting feature as thus described forms no part of this invention per se and is known in the prior art.

From time to time, waste material may be ejected from the tub 12 through opening 12*c*. The ejection of such waste material particularly occurs in the event that unauthorized material (e.g., metal, glass) were to be admitted into the tub 12. It is not practical to cover the opening 12*c* throughout operation of the tub grinder 10 since access must be had through the opening 12*c* in order to place waste material into the tub 12.

A deflection plate 50 is provided having a first plate member 51 secured to the floor 14 on the side of opening 15 opposite axis X—X. The plate 50 further includes a rotor cover portion 52 partially covering the circumferential area of the grinder member 26 which protrudes above floor 14. The addition of the deflection plate 50 results in limiting a trajectory which debris may follow when being ejected from the tub 12. Namely, a maximum trajectory line T is shown in FIG. 6 illustrating the limited trajectory of debris being ejected from the tub 12 by the grinding member 26. Plate 50 is sized so that trajectory T forms an angle AA of about 60° with floor 14. By reason of deflector plate 50, most debris will be ejected along a trajectory path which lies below line T in FIG. 6.

With the use of deflector plate 50 to provide a limited trajectory area for debris being ejected by grinding member 26, a partial cover may be effectively used to partially cover the tub opening 12*c* while permitting the majority of the tub opening 12*c* to remain open to permit new waste material to be added to the tub 12. Such a cover 60 is shown in FIGS. 3–5 and 7–9.

Figure 3:
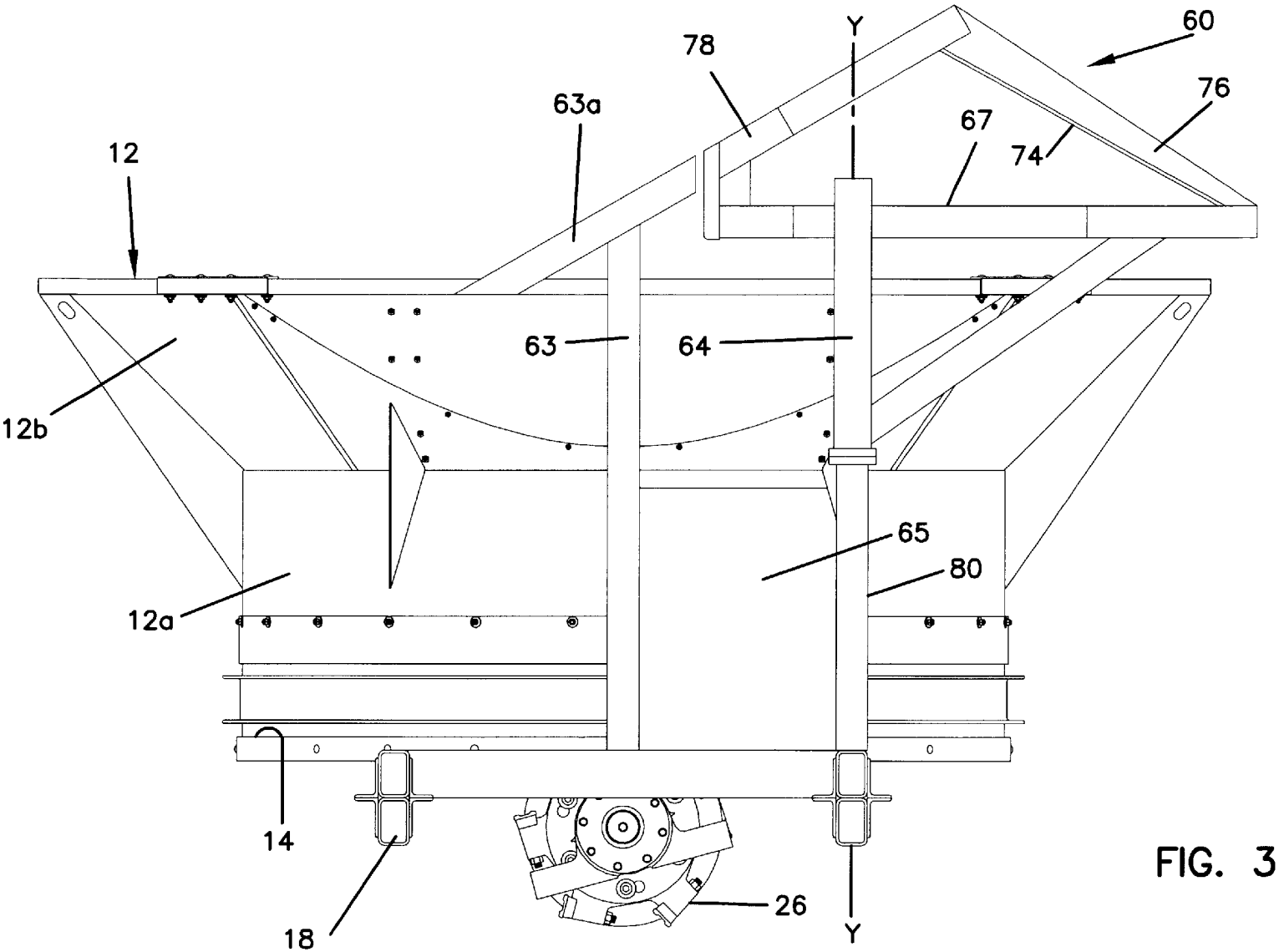
FIG. 3 is a front elevation view of a tub grinder according to the present invention with internal elements shown for purposes of clarity.
Figure 4:
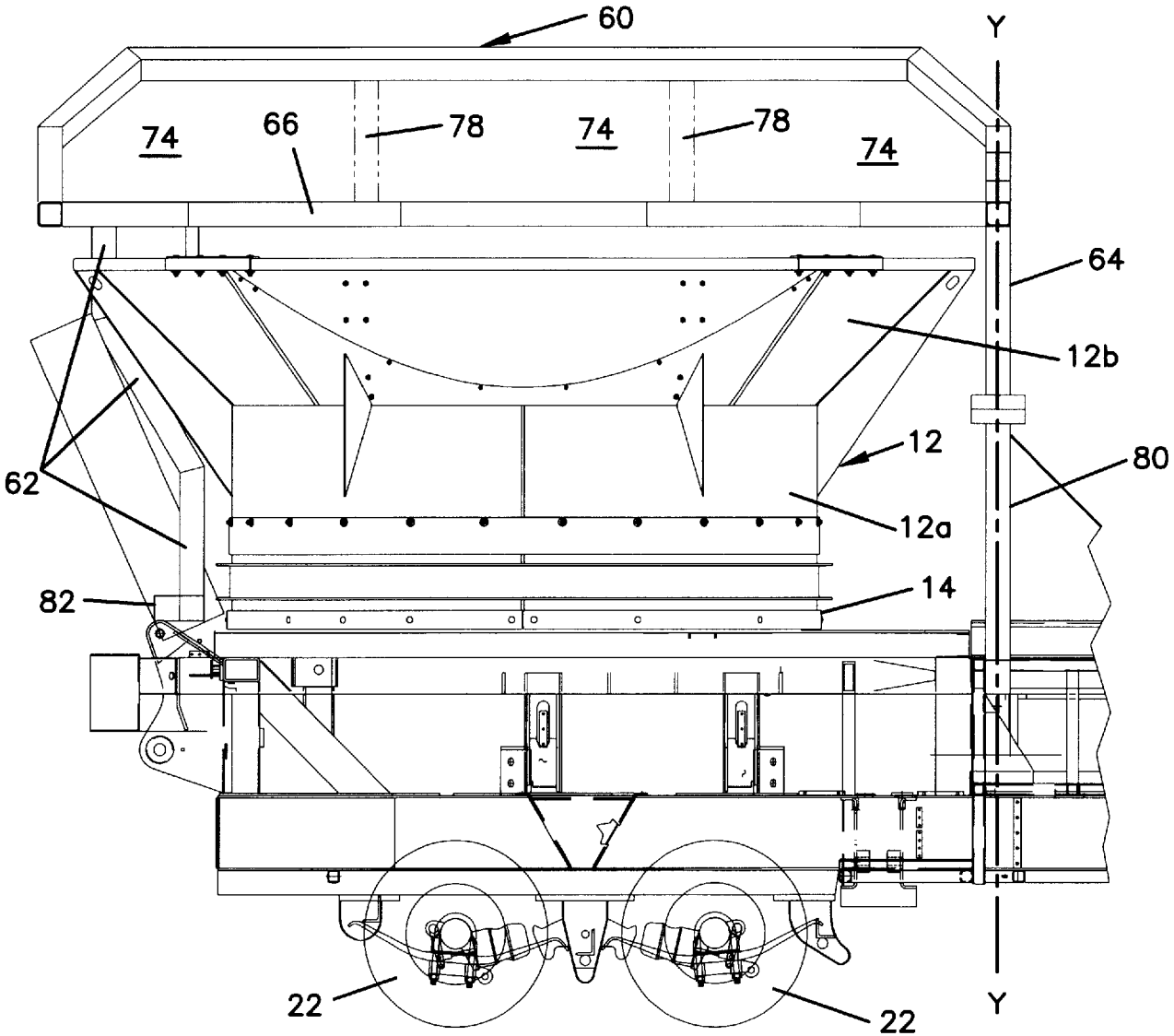
FIG. 4 is a right side elevation view of the tub grinder of FIG. 3.
Figure 5:
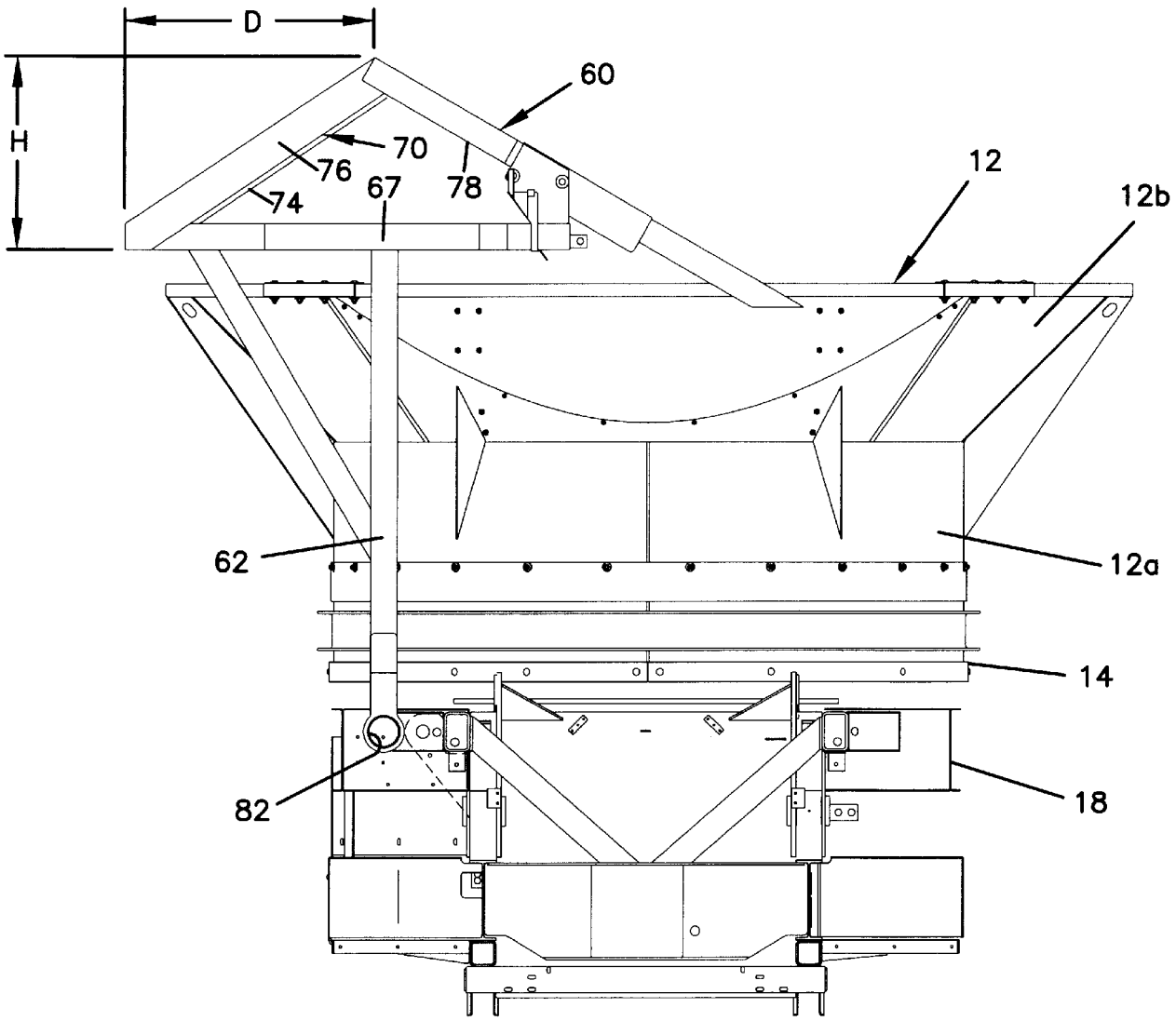
FIG. 5 is a rear elevation view of the tub grinder of FIG. 3.

The cover 60 is formed from a plurality of rigid steel members including a first vertical post 62 and a second vertical post 64. Posts 62 and 64 are joined by rigid horizontal bracing 66. Segmented outer horizontal bracing 68 (in the same plane as bracing 66) define an outer periphery of the cover member 60. Bracing 68 is secured to bracing 66 by cross-bracing 67. Cross-bracing 67 is further supported by upwardly projecting triangular reinforced bracing as shown in FIGS. 3 and 5. The triangular bracing includes a first segment 76 which extends upwardly and inwardly from outer bracing 68. Similarly, a second segment 78 extends downwardly and rearwardly from the upper portion of portion 76 and is secured to the bracing members by a vertical brace 81. A sheet steel cover 74 is secured to bracing 76.

The cover member 60 is secured to the frame 18 of the tub grinder 10. Second vertical member 64 is secured on a stationary post 80 and is pivotal on post 80 by means of an internal pivot rod received between aligned posts 64, 80.

A stationary support post 63 (FIG. 3) is secured to the frame 18. Post 63 is secured to post 80 by plate steel 65. Thus, post 63 aids to rigidly support the stationary post 80. Post 63 terminates at an inclined beam 63*a*. Beam 63*a* is aligned in close proximity (i.e., about one-half inch) to bracing 78. Beam 63*a* takes-up thrust forces acting in cover 60 which would otherwise urge cover 60 rearwardly (in the view of FIG. 3).

Figure 5A:
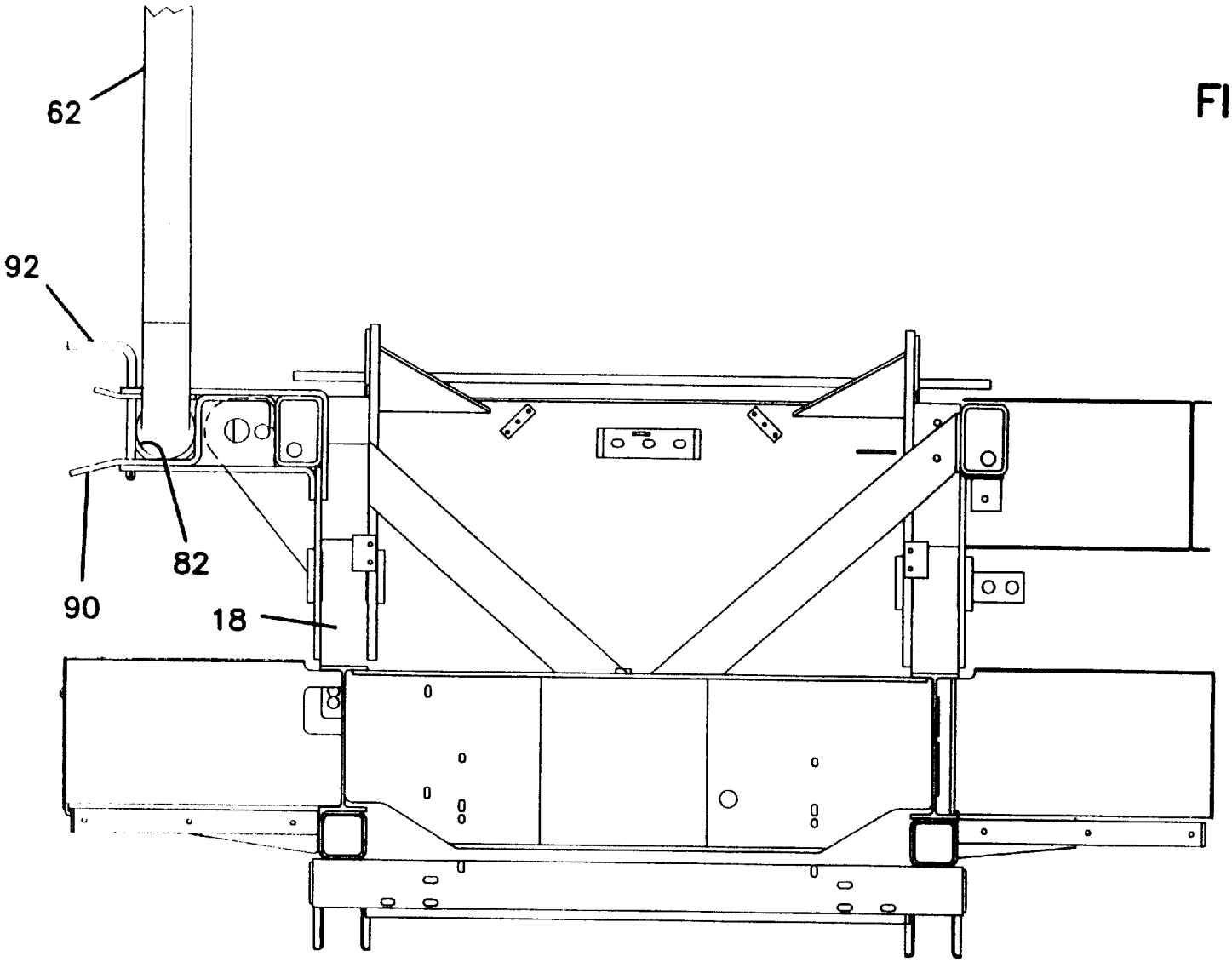
FIG. 5A is an enlargement of a portion of the view of FIG. 5.

First vertical post 62 terminates at a horizontal pipe member 82 which is received within a U-shaped seat 90 (shown in FIG. 5A) secured to the frame 18. A removable pin 92 prevents the pipe 82 from dislodging from the seat 90.

The pin 92 is removable by an operator such that the pipe 82 may be removed from the U-shaped seat and the entire cover member 60 may be rotated about the axis Y—Y such that the entire cover 60 is cleared from the tub 12. With the cover member 60 so cleared, the tub 12 may be freely rotated about pivot point P—P without obstruction from the cover 60.

When the cover 60 is in place, the cover 60 is sized such that its surface area covers about 25% of the diameter of the tub 12. For example, with reference to FIG. 5, the vertical height of the cover H is about 2 feet. The horizontal distance D from the leading end of the cover 60 to the maximum height is a distance of about 3 feet or 25% of the diameter of the tub opening 12*c*. The area of the inclined cover portion 74 is sized and positioned to cover the area defined by the trajectory T of FIG. 6. Namely, the cover 60 is positioned over the tub opening 12*c* on a side of the rotary member 26 opposite the plate 50.

The cover 60 and plate 50 cooperate such that the cover 60 is sized to cover the trajectory area as limited by the plate 50. Accordingly, the plate 50 restricts the area through which debris may be otherwise ejected from the tub 12. The cover 60 is sized and angled to reflect and deflect back into the tub 12 any such debris while leaving the remainder of the tub opening 12*c* open to permit additional waste material to be admitted to the tub 12.

With the structure thus described, the cooperating sizing and positioning of the plate 50 and cover 60 reduce ejection of waste material from the tub 12 without interfering with normal operations to place additional waste material into the tub 12. The cover 60 is not coupled to the tub 12. Therefore, the tub 12 may freely rotate. During such rotation, the plate 50 and cover 60 remain in desired position to block the ejection of waste from the tub 12. When it is desired to tilt the tub about axis P—P for cleaning or the like, the cover 60 may be easily rotated out of position (about axis Y—Y) to provide no obstruction to the tilting of the tub 12.

In addition to the possibility of material being ejected directly from the grinding member 26 out of the tub opening 12*c*, the possibility exists for debris to be ejected against the wall 12*a* and bounced out of the tub opening 12*c*. Accordingly, supplemental to the cover 60, the cylindrical wall 12*a* is provided with a plurality of deflecting rings 100 (shown in FIG. 6).

Each of the rings 100 is generally triangular in cross-section and formed of structural steel welded to the inner wall of the cylindrical wall 12*a*. The rings 100 have a deflection surface 102 which projects both radially inwardly and upwardly from the wall 12*a*. An upper surface 103 adds structural support to the deflector wall 102. In the absence of such rings 100, debris may impact the wall 12*a* and be deflected upwardly and out of the rear area of the tub opening 12*c*. The positioning and geometry of the deflector surfaces 102 are selected that any such debris is deflected back downwardly into the tub 12. Three such rings 100 are shown in FIG. 6 circumferentially surrounding the interior wall 12*a*. Accordingly, as the tub 12 rotates, the rings 100 rotate to provide a continuous deflection surface 102 opposing the grinding member 26. While three such rings 100 are shown, as few as one ring may be used.

From the foregoing detailed description, it can be seen that the present invention provides protection against debris being ejected from the tub 12 by reason of the grinding member 26. The cover 60 cooperates with the plate 50 to define a limited trajectory area which is then covered with a deflection cover 74 which deflects such debris back into the tub 12. The deflection cover 74 is sized so that a substantial portion of tub opening 12*c* remains open so that new waste material can be added to the interior of the tub 12 during operation of the machine. The cover 60 is easily rotated out of position so that the tub 12 may be pivoted for cleaning and the like. In addition, the deflector rings 100 prevent debris from being projected onto the wall 12*a* of the tub 12 and then being subsequently projected and deflected through the opening 12*c*. While the present invention has been disclosed in the preferred embodiment, it would be appreciated the modifications and equivalents of the disclosed concepts such those as readily occur to one skilled in the art are intended to be included within the scope of the claims which are impended hereto.

Notwithstanding the foregoing description of a tub grinder 10 containing internal rings 100 in combination with a cover 60, Applicants have, through testing and further consideration, determined that a preferred embodiment of the tub grinder 10 will not include rings 100. Namely, Applicants have determined that the rings 100 impair operation of the tub grinder 10. Namely, the rings 100 present an obstacle which impairs or impedes downward flow of material in the tub 12 as well as reducing the interior volume of the tub 12. Also, the rings 100 can block material from being emptied from the tub 12 when the tub 12 is rotated to a discharge position. Further, from time-to-time, objects may jam between the floor 14 and the tub 12. The absence of rings 100 permits such material to move up the wall 12*a* of the tub 12 to relieve interference.

In addition to adversely effecting performance, the rings 100 do not materially reduce material discharge from the tub 12. Namely, as discussed above, the intent of the rings 100 is to re-direct material projected from the grinder 26 to the tub wall 12*a*. In fact, any such material must pass through material resident in the tub 12 which interferes with such travel of the projected waste material. According, reduction of waste discharge is not improved through the addition of the rings 100.

Finally, the rings 100 will not deflect material downwardly. Instead, material may bridge two rings 100 and not impact a deflecting surface 102 of a ring 100. In view of the fact the rings 100 impair performance and to not materially reduce discharge, the rings 100 will not be used in a preferred embodiment.

What is claimed is:

1. A tub grinder comprising:

a frame having a floor with a floor opening formed therethrough;

a tub mounted on said frame with a wall of said tub surrounding said floor opening, said tub having a lower end in close proximity to said floor, said tub having an opposite upper end defining a tub opening;

a drive mechanism for rotating said tub about a generally vertical axis;

a grinding member mounted on said frame, said grinding member mounted for rotation about a generally horizontal axis with at least a portion of a circumferential surface of said grinder member exposed through said floor opening, said circumferential surface rotating upwardly through said floor opening on a first side thereof and rotating downwardly though said floor opening on an opposite second side thereof;

a deflection plate extending over said first side of said floor opening to partially cover said grinding member above said floor while leaving an exposed portion of said grinding member adjacent said second side of said floor opening; and a deflection cover positioned above said tub opening covering only a portion of said tub opening on a side thereof adjacent said second side of said floor opening.

2. A tub grinder according to claim 1 wherein said cover is inclined at an angle to deflect into said tub material projected against said cover by said grinding member.

3. A tub grinder according to claim 1 wherein said deflection plate defines a restricted discharge area at said tub opening wherein material projected from said grinding member is directed to said discharge area, said cover sized and positioned to cover said discharge area.

4. A tub grinder according to claim 3 wherein said cover is sized to extend over about 25% of an area of said tub opening.

5. A tub grinder according to claim 1 wherein said tub is secured to said frame with means for tilting said tub relative to said frame;

said cover secured to said frame with means for displacing said cover relative to said tub a distance sufficient for said tub to be tilted without interference from said cover.

6. The tub grinder of claim 1, wherein the tub further includes a top edge, and wherein the cover includes oppositely disposed ramped portions above the top edge.

7. A tub grinder, comprising:

a tub positioned above a floor that defines a floor opening, the tub having an upper end defining a tub opening and a side wall that surrounds the floor opening;

a rotatable grinding member positioned such that at least a portion of the grinding member is exposed through the floor opening;

a deflection plate positioned within the tub that extends over a portion of the floor opening and over a first portion of the grinding member while leaving exposed a second portion of the grinding member; and a deflection cover covering only a portion of the tub opening, the deflection cover being positioned to deflect into the tub material ejected from the second portion of the grinding member while contemporaneously permitting addition of material into the tub opening.

8. A tub grinder according to claim 7, further comprising a mechanism for rotating the tub about a generally vertical axis.

9. A tub grinder of claim 7, wherein the deflection cover extends over approximately 25% of an area of the tub opening.

10. The tub grinder of claim 7, wherein the deflection cover is inclined at an angle to deflect into the tub material ejected from the second portion of the grinding member.

11. The tub grinder of claim 7, wherein:

the tub is secured to the frame with a tilting mechanism for tilting the tub relative to the frame; and the deflection cover is secured to the frame with an actuator to permit displacement of the deflection cover relative to the tub a distance sufficient for the tub to be tilted without interference from the deflection cover.

12. The tub grinder of claim 7, wherein the grinding member comprises a hammermill.

* * * * *